US006847167B1

(12) United States Patent
Van Erk

(10) Patent No.: US 6,847,167 B1
(45) Date of Patent: Jan. 25, 2005

(54) HIGH-PRESSURE GAS DISCHARGE LAMP

(75) Inventor: Willem Van Erk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 225 days.

(21) Appl. No.: 09/709,265

(22) Filed: Nov. 9, 2000

(30) Foreign Application Priority Data

Nov. 11, 1999 (EP) ..... 99203770

(51) Int. Cl.[7] ..... H01J 61/30
(52) U.S. Cl. ..... 313/634; 313/637; 313/643
(58) Field of Search ..... 313/634, 637, 313/643, 567, 578, 576, 113

(56) References Cited

U.S. PATENT DOCUMENTS 4,001,626 A 1/1977 Drop et al. ..... 313/229
4,935,668 A * 6/1990 Hansler et al. ..... 315/82
5,479,065 A * 12/1995 Sugimoto et al. ..... 313/113
5,592,050 A * 1/1997 Higashi et al. ..... 313/576
5,965,984 A * 10/1999 Horiuchi et al. ..... 313/637
6,069,456 A * 5/2000 Fromm et al. ..... 313/637

FOREIGN PATENT DOCUMENTS

DE 2455277 6/1975 ..... H01J/61/68
EP 0605248 A2 7/1994 ..... H01J/61/82

OTHER PUBLICATIONS http://www.webelements.com/ Copyright 1993–2003 Mark Winter [The University of Sheffield and WebElements Ltd, UK].*

* cited by examiner

*Primary Examiner*—Edward J. Glick
*Assistant Examiner*—Elizabeth Keaney

(57) ABSTRACT

The high-pressure gas discharge lamp (1) comprises a lamp vessel (2) having a wall (3) which is exposed to a wall load of at least 30 W/cm$^2$ during operation of the lamp, and a discharge space (4) in which a pair of electrodes (5) is disposed. The discharge space (4) has a filling which comprises mercury, argon, and halides (not fluorides) of tin and indium, to which filling an alkali metal halide is added, the alkali metal being potassium, rubidium, or cesium, and the halide being chlorine, bromine, or iodine. The high-pressure discharge lamp (1) according to the invention has an improved resistance against corrosion and crystallization of the quartz glass wall (3).

13 Claims, 1 Drawing Sheet

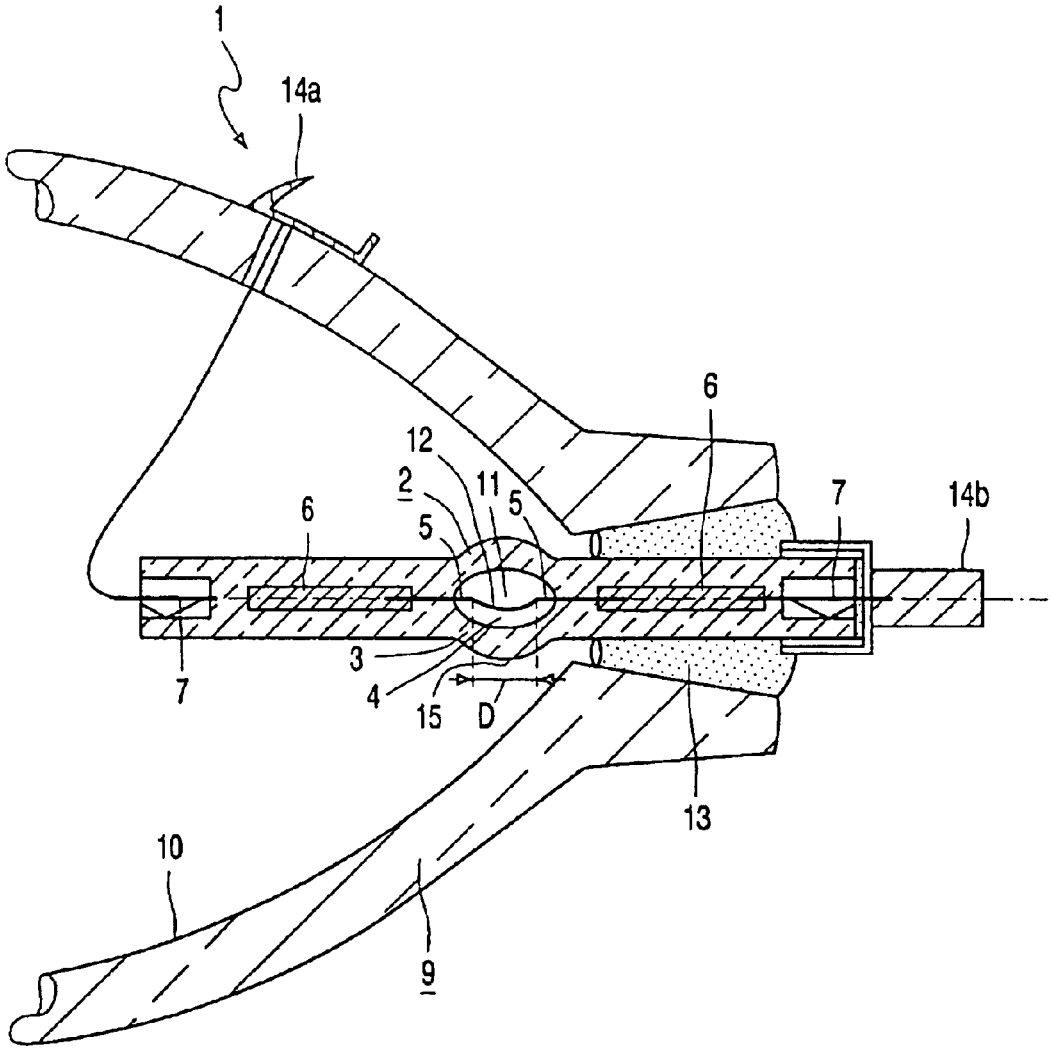
1
14a
6
12
2
11
5
5
6
7
14b
7
3
4
15
D
13
10
9

HIGH-PRESSURE GAS DISCHARGE LAMP

BACKGROUND OF THE INVENTION

1. Field of the Invention

The invention relates to a high-pressure gas discharge lamp comprising a quartz glass lamp vessel which is closed in a gastight manner, with a space which is enclosed by a wall and in which a pair of electrodes is arranged, an outer surface of said wall extending between the pair of electrodes and a filling provided in the space and comprising a rare gas and halides of tin and indium.

2. Discussion of the Prior Arts

Such a high-pressure gas discharge lamp is known from the patent document DE 24 55 277 (=U.S. Pat. No. 4,001,626). The lamp generates light of a comparatively high intensity during operation because tin halide is present in the filling. The presence of indium halide in the filling gives the emitted light a color point and a color temperature which approximate an envisaged color point and an envisaged color temperature to a certain extent. The lamp vessel is made of quartz glass, i.e. glass having an $SiO_2$ content of at least 95% by weight. A disadvantage of the known lamp is an unacceptably fast corrosion and/or crystallization of the wall of the lamp vessel. This corrosion and/or crystallization is due partly to an attack by the filling. The result is that the lamp has a comparatively bad lumen maintenance, and scattering of light will occur, so that focusing of the light is comparatively bad. The corrosion and/or crystallization leads to additional disadvantages involving a comparatively high risk of a comparatively short life of the lamp and/or inflation, i.e. an increase in the volume enclosed by the lamp vessel wall.

The same patent document also describes the filling, to which lithium chloride or sodium chloride has been added. The emitted light of a lamp whose filling has such an additive has a color point and a color temperature which approximate the envisaged color point and the envisaged color temperature comparatively closely. Such a lamp, however, suffers the disadvantage of a fast corrosion and/or crystallization of the lamp vessel wall even more strongly.

SUMMARY OF THE INVENTIONS

It is an object of the invention to provide a high-pressure gas discharge lamp of the kind described in the opening paragraph in which the above disadvantages of corrosion and crystallization of quartz glass are counteracted.

According to the invention, this object is achieved in that the high-pressure gas discharge lamp of the kind described in the opening paragraph is characterized in that the wall has a wall load of at least 30 W/cm$^2$ at its outer surface, and in that the filling comprises an alkali metal halide with at least one alkali ion and at least one halide ion, said alkali ion being chosen from the group formed by potassium, rubidium, and cesium, and the halide ion being chosen from the group formed by chlorine, bromine, and iodine.

Lithium and sodium halides form part of the group of alkali halides. Potassium, rubidium, and cesium halides also belong to this group. The patent document DE 24 55 277 describes a disadvantage of lithium chloride and sodium chloride in the filling as regards corrosion and crystallization of the lamp vessel wall. Since potassium, rubidium, and cesium halides also belong to this same alkali group, it is to be expected that these halides will lead to an unacceptably fast corrosion and crystallization of quartz glass if one or several of these halides were present in the filling. The expectation is accordingly that the use of potassium, rubidium, or cesium halide in the filling of the known lamp is not useful. It was surprisingly found in experiments that the lamp according to the invention has a longer life and a reduced explosion risk both compared with the known lamp and compared with lamps having both lithium or sodium chloride and tin and indium halides in the filling. The surprising effect manifests itself in lamps with a comparatively high wall load on the outer surface of the wall of at least 30 W/cm$^2$. Major portions of the wall have a temperature above 800° C in lamps with such a high wall load.

A wall load of 30 W/cm$^2$ occurs in lamps with a short discharge arc, for example of at most 10 mm. If a practically useful luminous flux is to be obtained from lamps having such a short discharge arc, a comparatively high pressure is often present in the space, of the lamp vessel during operation so as to obtain a required lamp voltage. The comparatively high pressure in the lamp leads to a strong convection, as a result of which locally a high temperature occurs in the lamp vessel wall, often a temperature of more than 1050° C. The high temperature involves a considerable increase in the risk of corrosion and/or crystallization of the lamp vessel wall. It was surprisingly found in the lamp according to the invention that the corrosion and crystallization of quartz glass are reduced both compared with the known lamp and compared with lamps with both lithium or sodium chloride and tin and indium halides in their filling. The high-pressure gas discharge lamp according to the invention with a wall load on the outer surface of more than 30 W/cm$^2$ and with a discharge arc of less than 3 mm was found to be highly suitable for projection applications.

In a favorable embodiment of the high-pressure gas discharge lamp, the alkali ion is potassium. Very good results were obtained in experiments especially with the use of potassium halide in the lamp. Lamps with potassium halide in their filling showed hardly any traces of corrosion and crystallization of quartz glass after 1000 hours of operation. An additional advantage of these lamps is that an attack on molybdenum foils, components of electrical conductors passed through the wall of the lamp vessel and connected to the electrodes, has been strongly reduced.

In a preferred embodiment of the high-pressure gas discharge lamp, the halide ion is bromine. The halide together with electrode material, for example tungsten, generates a cycle in the lamp by which blackening of the lamp vessel wall caused by deposits of the electrode material is counteracted during lamp operation. Experiments have shown that, if the halide is chlorine, the tungsten cycle proceeds with difficulty, so that the lamp has a greater risk of blackening of the wall than if the halide were bromine or iodine. Experiments have also shown that, if the halide is iodine, tin iodide is formed in the lamp. The tin iodide thus formed has a number of properties, among them an absorption of radiation in the blue region of the spectrum. This absorption leads to a reduced efficacy of the lamp. In addition, this absorption may lead to color differences in the lamp, because the discharge arc has a diameter gradient, for example caused by convection, which means that there will be a gradient in the absorption. These color differences are perceived as unfavorable by an observer. It was also found in experiments that, if the halide is bromine, these effects occur to a much lesser extent or not at all.

In an alternative embodiment of the high-pressure gas discharge lamp, the high-pressure gas discharge lamp comprises a reflector in which the lamp vessel is fixed. The generation of a large quantity of lumens on a given projection screen, the so-called screen lumens, is of essential importance if the lamp according to the invention is used in projection applications. The lamp vessel is for this purpose placed in the reflector so that the light originating from the discharge arc is reflected and shaped into a beam. To obtain a large quantity of screen lumens, it is desirable for the discharge arc to be short during operation, for example to have a length of at most 3 mm. It is also desirable for the discharge arc to be stable and to be present in, or at least very closely adjacent to a focal point of the reflector. The fixation of the lamp vessel in the reflector ensures in a simple manner that the discharge arc will be located in the focal point of the reflector. Very favorable conditions for an efficient reflection and focusing of the light are obtained thereby, and accordingly a large quantity of screen lumens.

In an alternative embodiment of the high-pressure gas discharge lamp, the high-pressure gas discharge lamp is a DC lamp. Experiments with potassium halide, rubidium halide, or cesium halide in the filling, especially in the form of a bromide, have surprisingly shown that these halides operate as gas phase emitters. The gas phase emitter reduces the temperature required by the cathode for supplying electrons during lamp operation. A temperature of the tungsten electrode of 3000 to 3600 K is necessary in similar lamps without emitter in order to achieve lamp currents of 4 to 8 A. In the presence of such a gas phase emitter, however, such a current can be realized at an electrode temperature which is approximately 500 K lower. Since the above halides are effective as gas phase emitters, the advantage is obtained especially in DC lamps that the corrosion of the cathode, the so-called burning-back, is strongly reduced. This reduced corrosion means that the discharge arc increases its length comparatively slowly, so that the discharge arc retains a comparatively high stability for a longer period.

It is to be noted that the use of rare earth halides in a high-pressure gas discharge lamp with a quartz glass lamp vessel is known inter alia from EP-A2-0 605 248. Rare earth halides are understood to be the halides of the elements with atom numbers 21, 39, and 57 to 71. The rare earth halides, however, are comparatively expensive and react comparatively readily with the quartz glass lamp vessel. As a result, a lamp having a rare earth halide in its filling also has the disadvantage of a fast corrosion and crystallization of the quartz glass lamp vessel.

BRIEF DESCRIPTION OF THE DRAWINGS

An embodiment of the high-pressure gas discharge lamp according to the invention will be explained in more detail with reference to a drawing.

The sole FIGURE of the drawing is an elevation of an embodiment of the high-pressure gas discharge lamp according to the invention.

DETAILED DESCRIPTION OF PREFERRED EMBODIMENTS

The high-pressure gas discharge lamp 1 in the FIGURE comprises a quartz glass lamp vessel 2 with a wall 3 having an outer surface 15, and also comprises a space 4 enclosed by the wall 3, in which space two electrodes 5 are arranged. The electrodes 5 are made from an alloy of tungsten with 26% of rhenium by weight. Alternatively, the electrodes 5 may be made from molybdenum, tungsten, rhenium, or may be composed of parts consisting of tungsten, molybdenum, and/or rhenium. The electrodes 5 are each connected to a respective external contact point 14*a* and 14*b* by means of a molybdenum foil 6 which is embedded in a gastight manner in the wall 3 and by means of an external current conductor 7. A filling comprising argon as a rare gas, mercury as a buffer gas, and bromides of tin, indium, and potassium is present in the space 4. The high-pressure gas discharge lamp 1 is constructed as an AC lamp, but it may alternatively be a DC lamp. In the high-pressure gas discharge lamp 1 shown, the lamp vessel 2 is fixed with cement 13 in a concave elliptical reflector 9 with a reflecting layer 10. Alternatively, the lamp vessel 2 may be fixed in different manners, for example clamped, in a reflector of different shape, for example parabolic. The reflector 9 is open, but it may alternatively be closed, for example with a closing plate. The reflector 9 has a focus 11. The high-pressure gas discharge lamp 1 shown is particularly suitable for use as a projection lamp and has a rated power of, for example, 400 W, a short electrode distance D of 2 mm, and a high pressure during lamp operation, for example 60 bar. The lamp has a high wall load at its outer surface 15 of 40 W/cm$^2$. The short electrode distance D and the high pressure give the lamp a stable discharge arc 12 which is strongly contracted and is present substantially in or adjacent to the focus 11 of the reflector 9. A number of lamp results are given in Table 1 below for high-pressure gas discharge lamps according to the invention and for lamps having sodium halide or lithium halide in the filling, and for lamps whose fillings arc free from alkali metal halides. The wall load at the outer surface 15 of the wall 3 is approximately 40 W/cm$^2$ for all lamps in table 1.

TABLE 1

| | L1 | L2 | L3 | L4 | L5 | L6 |
|---|---|---|---|---|---|---|
| Filling | Hg, InBr, $SnBr_2$, Ar | Hg, InBr, $SnBr_2$, Ar | Hg, InBr, $SnBr_2$, Ar | Hg, InBr, $SnBr_2$, Ar | Hg, InBr, $SnBr_2$, Ar | Hg, InBr, $SnBr_2$, Ar |
| Alkali halide | KBr | LiBr | KBr | LiBr | NaBr | — |
| Power/D | 400/2 | 400/2 | 400/2 | 400/2 | 400/2 | 400/2 |
| Lamp type | AC | AC | DC | DC | DC | DC |
| Efficacy (lm/W) | 59 | 63 | 62 | 66 | 71 | 65 |
| Color temperature. | 6300 | 6200 | 6300 | 6000 | 5000 | 8500 |
| Life test behavior | Up to 1000 h satisfactory | After 100 h crystallization and inflation | Up to 800 h satisfactory | Fails after 5 h owing to corrosion | Fails after 75 h owing to corrosion | Stopped after 400 h because of corrosion |

The lamp results show a difference in luminous efficacy of the lamp according to the invention and the efficacy of the known lamp. However, if the lamp according to the invention is used in a usual projection system based on a separation of the light into red, green, and blue, an RGB system, it was found that the system efficacy is at least substantially the same as for the known lamp. The choice of the projection system, however, is arbitrary and the system efficacy is strongly dependent on this choice, so the specification of a system efficacy does not make much sense.

The lamp results also show that the high-pressure gas discharge lamp with potassium bromide (L1, L3) in the filling suffers much less corrosion of the quartz glass of the wall than do high-pressure gas discharge lamps without alkali metal halides (16) or with Li or Na bromide (L2, L4, L5) in the filling. The result of the reduced corrosion is that the lamp has a longer useful life, compare L3 with L4; L5 and L6 and L1 with L2.

What is claimed is:

1. A high-pressure gas discharge lamp comprising:

a quartz glass lamp vessel which is closed in a gastight manner, with a space which is enclosed by a wall and in which a pair of electrodes is arranged;

an outer surface of said wall extending between the pair of electrodes; and a filling provided in the space and comprising a rare gas, a mercury buffer gas and halides of tin and indium, wherein the wall has a wall load of at least 30 W/cm$^2$ at its outer surface, and in that the filling further consists essentially of an alkali metal halide with at least one alkali ion and at least one halide ion, said alkali ion being chosen from the group formed by potassium, rubidium, and cesium, and the halide ion being chosen from the group formed by chlorine, bromine, and iodine, whereby rare earth halides are excluded from the filling.

2. A high-pressure gas discharge lamp as claimed in claim 1, wherein the lamp has a discharge arc with a length of at most 10 mm.

3. A high-pressure gas discharge lamp as claimed in claim 1, wherein the high-pressure gas discharge lamp comprises a reflector in which the lamp vessel is fixed.

4. A high-pressure gas discharge lamp as claimed in claim 1, wherein the high-pressure gas discharge lamp is a DC lamp.

5. A high-pressure gas discharge lamp comprising:

a quartz glass lamp vessel which is closed in a gastight manner, with a space which is enclosed by a wall and in which a pair of electrodes is arranged, an outer surface of said wall extending between the pair of electrodes, and a filling provided in the space and comprising a rare gas, a mercury buffer gas and halides of tin and indium, wherein the wall has a wall load of at least 30 W/cm$^2$ at its outer surface, and in that the filling further consists essentially of an alkali metal halide with at least one alkali ion which is potassium and at least one halide ion, the halide ion being chosen from the group formed by chlorine, bromine, and iodine.

6. A high-pressure gas discharge lamp as claimed in claim 5, wherein the lamp has a discharge arc with a length of at most 10 mm.

7. A high-pressure gas discharge lamp as claimed in claim 5, wherein the high-pressure gas discharge lamp comprises a reflector in which the lamp vessel is fixed.

8. A high-pressure gas discharge lamp as claimed in claim 5, wherein the high-pressure gas discharge lamp is a DC lamp.

9. A high-pressure gas discharge lamp comprising:

a quartz glass lamp vessel closed in a gastight manner having a space enclosed by a wall, a pair of electrodes being arranged in the space;

an outer surface of the wall extending between the pair of electrodes; and a filling provided in the space, the filling comprising a rare gas, a mercury buffer gas and halides of tin and indium, wherein the wall has a wall load of at least 30 W/cm$^2$ at its outer surface, and the filling further consists essentially of an alkali metal halide with at least one alkali ion and at least one halide ion, said alkali ion being rubidium, and the halide ion being chosen from the group formed by chlorine, bromine, and iodine.

10. A high-pressure gas discharge lamp as claimed in claim 9, wherein the lamp has a discharge arc with a length of at most 10 mm.

11. A high-pressure gas discharge lamp as claimed in claim 9, wherein the high-pressure gas discharge lamp comprises a reflector in which the lamp vessel is fixed.

12. A high pressure gas discharge lamp as claimed in claim 9, wherein the high-pressure gas discharge lamp is a DC lamp.

13. A high-pressure gas discharge lamp comprising:

a quartz glass lamp vessel which is closed in a gastight manner, with a space which is enclosed by a wall and in which a pair of electrodes is arranged;

an outer surface of said wall extending between the pair of electrodes; and a filling provided in the space and comprising a rare; gas, a mercury buffer gas and halides of tin and indium, and wherein the wall has a wall load of at least 30 W/cm$^2$ at its outer surface, and in that the filling further consists essentially of an alkali metal halide with at least one alkali ion and at least one halide ion, said alkali ion being chosen from the group formed by potassium, rubidium, and cesium, and the halide ion being bromine, whereby rare earth halides are excluded from the filling.

* * * * *